US007800558B2

(12) United States Patent
Routley et al.

(10) Patent No.: US 7,800,558 B2
(45) Date of Patent: Sep. 21, 2010

(54) DISPLAY DRIVER CIRCUITS FOR ELECTROLUMINESCENT DISPLAYS, USING CONSTANT CURRENT GENERATORS

(75) Inventors: Paul R. Routley, Longstanton (GB); Euan C. Smith, Longstanton (GB)

(73) Assignee: Cambridge Display Technology Limited, Cambridgeshire (GB)

( * ) Notice: Subject to any disclaimer, the term of this patent is extended or adjusted under 35 U.S.C. 154(b) by 719 days.

(21) Appl. No.: 10/518,286

(22) PCT Filed: Jun. 12, 2003

(86) PCT No.: PCT/GB03/02550

§ 371 (c)(1),
(2), (4) Date: Jul. 5, 2005

(87) PCT Pub. No.: WO03/107318

PCT Pub. Date: Dec. 24, 2003

(65) Prior Publication Data

US 2006/0001613 A1 Jan. 5, 2006

(30) Foreign Application Priority Data

Jun. 18, 2002 (GB) ..... 0213989.7

(51) Int. Cl.
*G09G 3/30* (2006.01)

(52) U.S. Cl. ..... 345/77; 345/82

(58) Field of Classification Search ..... 345/76–83; 315/169.3

See application file for complete search history.

(56) References Cited

U.S. PATENT DOCUMENTS 3,714,374 A * 1/1973 Sobel ..... 348/801
4,539,507 A 9/1985 VanSlyke et al. ..... 313/504
4,823,121 A 4/1989 Sakamoto et al. ..... 340/781
5,075,596 A * 12/1991 Young et al. ..... 315/169.3
5,594,463 A 1/1997 Sakamoto ..... 345/76
5,748,160 A * 5/1998 Shieh et al. ..... 345/82
5,903,246 A 5/1999 Dingwall (Continued)

FOREIGN PATENT DOCUMENTS

EP 0 717 446 A2 6/1996

(Continued)

OTHER PUBLICATIONS

International Search Report in PCT/GB03/02550 dated Oct. 17, 2003.

*Primary Examiner*—Chanh Nguyen
*Assistant Examiner*—Allison Walthall
(74) *Attorney, Agent, or Firm*—Marshall, Gerstein & Borun LLP

(57) ABSTRACT

Display driver circuits for driving an organic light emitting diode display, particularly a passive matrix display with greater efficiency are described. The display includes at least one electroluminescent display element, and the driver includes at least one substantially constant current generator for driving the display element. The display driver control circuitry includes a drive voltage sensor for sensing a voltage on a first line in which the current is regulated by the constant current generator; and a voltage controller coupled to the drive voltage sensor for controlling the voltage of a supply for the constant current generator in response to said sensed voltage, and configured to control the supply voltage to increase the efficiency of said display driver.

17 Claims, 10 Drawing Sheets

U.S. PATENT DOCUMENTS

| | | | | |
|---|---|---|---|---|
| 5,949,194 | A | 9/1999 | Kawakami et al. | |
| 6,014,119 | A | 1/2000 | Staring et al. | 345/82 |
| 6,201,520 | B1 | 3/2001 | Iketsu et al. | 345/76 |
| 6,323,849 | B1 | 11/2001 | He et al. | 345/204 |
| 6,332,661 | B1 | 12/2001 | Yamaguchi | 317/108 |
| 6,414,661 | B1 * | 7/2002 | Shen et al. | 345/82 |
| 6,424,326 | B2 | 7/2002 | Yamazaki et al. | 345/77 |
| 6,509,854 | B1 * | 1/2003 | Morita et al. | 341/144 |
| 6,518,962 | B2 | 2/2003 | Kimura et al. | |
| 6,617,801 | B2 * | 9/2003 | Ishizuka et al. | 345/77 |
| 6,730,966 | B2 * | 5/2004 | Koyama | 257/350 |
| 6,738,031 | B2 | 5/2004 | Young et al. | |
| 6,847,171 | B2 | 1/2005 | Tam et al. | |
| 7,239,309 | B2 | 7/2007 | Smith et al. | |
| 2001/0024186 | A1 | 9/2001 | Kane et al. | |
| 2002/0084812 | A1 * | 7/2002 | Nishitoba | 327/108 |
| 2002/0101395 | A1 | 8/2002 | Inukai | 345/83 |
| 2002/0167471 | A1 * | 11/2002 | Everitt | 345/76 |
| 2002/0175634 | A1 | 11/2002 | Ishizuka et al. | 315/169.1 |
| 2003/0011314 | A1 * | 1/2003 | Numao | 315/169.3 |
| 2006/0001613 | A1 | 1/2006 | Routley et al. | |

FOREIGN PATENT DOCUMENTS

| | | | |
|---|---|---|---|
| EP | 811 866 | A1 | 12/1997 |
| EP | 0 717 446 | A3 | 2/1999 |
| EP | 923 067 | A1 | 6/1999 |
| EP | 1 079 361 | A1 | 2/2001 |
| EP | 1 091 339 | A2 | 4/2001 |
| EP | 1 091 339 | A3 | 4/2001 |
| EP | 1 096 466 | A1 | 5/2001 |
| EP | 1 291 838 | A1 | 3/2003 |
| GB | 2 360 870 | | 10/2001 |
| GB | 2 381 643 | | 5/2003 |
| GB | 2 381 644 | | 5/2003 |
| GB | 2 386 462 | | 9/2003 |
| JP | 5-35207 | | 2/1993 |
| JP | 2000-132133 | | 5/2000 |
| JP | 2002-169511 | | 6/2002 |
| WO | WO 90/13148 | | 11/1990 |
| WO | WO 95/06400 | | 3/1995 |
| WO | WO-99/42983 | | 8/1999 |
| WO | WO 99/48160 | | 9/1999 |
| WO | WO-99/54936 | | 10/1999 |
| WO | WO-01/20591 | | 3/2001 |
| WO | WO-01/27910 | | 4/2001 |
| WO | WO 03/091983 | A1 | 11/2003 |

* cited by examiner

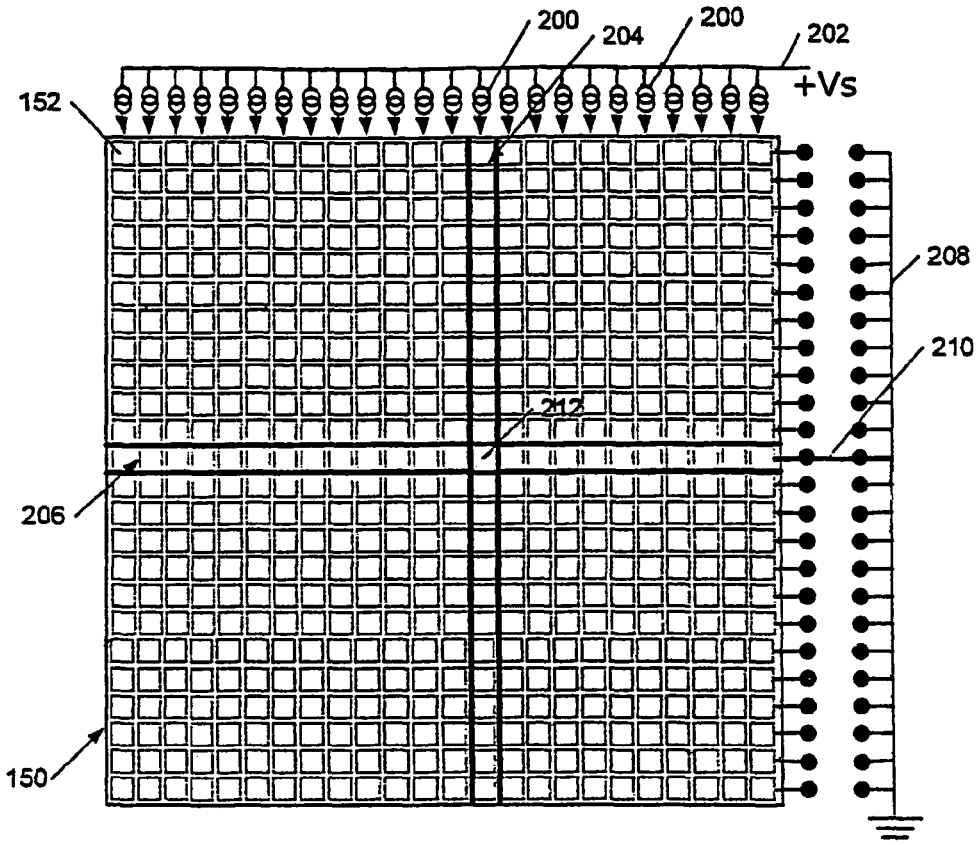
Figure 2a
Figure 2b
Figure 2c
Figure 2d
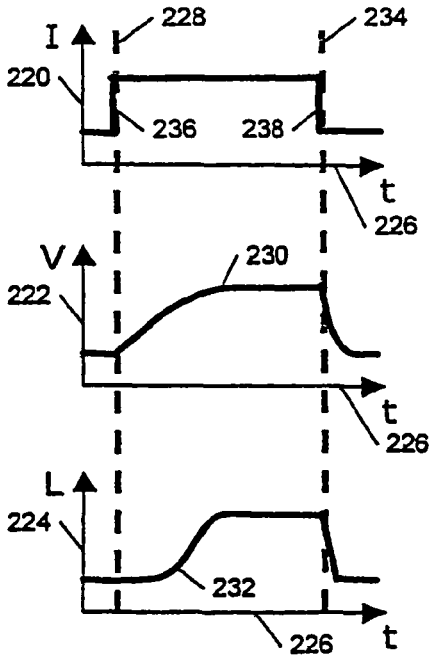

300

DISPLAY DRIVER CIRCUITS FOR ELECTROLUMINESCENT DISPLAYS, USING CONSTANT CURRENT GENERATORS

This is the U.S. national phase of International Application No. PCT/GB03/02550 filed Jun. 12, 2003, the entire disclosure of which is incorporated herein by reference.

This invention generally relates to display driver circuits for electro-optic displays, and more particularly relates to circuits and methods for driving organic light emitting diode displays, especially passive matrix displays, with greater efficiency.

Organic light emitting diodes (OLEDs) comprise a particularly advantageous form of electro-optic display. They are bright, colourful, fast-switching, provide a wide viewing angle and are easy and cheap to fabricate on a variety of substrates. Organic LEDs may be fabricated using either polymers or small molecules in a range of colours (or in multi-coloured displays), depending upon the materials used. Examples of polymer-based organic LEDs are described in WO 90/13148, WO 95/06400 and WO 99/48160; examples of so called small molecule based devices are described in U.S. Pat. No. 4,539,507.

A basic structure 100 of a typical organic LED is shown in FIG. 1*a*. A glass or plastic substrate 102 supports a transparent anode layer 104 comprising, for example, indium tin oxide (ITO) on which is deposited a hole transport layer 106, an electroluminescent layer 108, and a cathode 110. The electroluminescent layer 108 may comprise, for example, a PPV (poly(p-phenylenevinylene)) and the hole transport layer 106, which helps match the hole energy levels of the anode layer 104 and electroluminescent layer 108, may comprise, for example, PEDOT:PSS (polystyrene-sulphonate-doped polyethylene-dioxythiophene). Cathode layer 110 typically comprises a low work function metal such as calcium and may include an additional layer immediately adjacent electroluminescent layer 108, such as a layer of aluminium, for improved electron energy level matching. Contact wires 114 and 116 to the anode the cathode respectively provide a connection to a power source 115. The same basic structure may also be employed for small molecule devices.

In the example shown in FIG. 1*a* light 120 is emitted through transparent anode 104 and substrate 102 and such devices are referred to as "bottom emitters". Devices which emit through the cathode may also be constructed, for example by keeping the thickness of cathode layer 110 less than around 50-100 nm so that the cathode is substantially transparent.

Organic LEDs may be deposited on a substrate in a matrix of pixels to form a single or multi-colour pixellated display. A multicoloured display may be constructed using groups of red, green, and blue emitting pixels. In such displays the individual elements are generally addressed by activating row (or column) lines to select the pixels, and rows (or columns) of pixels are written to, to create a display. So-called active matrix displays have a memory element, typically a storage capacitor and a transistor, associated with each pixel whilst passive matrix displays have no such memory element and instead are repetitively scanned, somewhat similarly to a TV picture, to give the impression of a steady image.

FIG. 1*b* shows a cross section through a passive matrix OLED display 150 in which like elements to those of FIG. 1*a* are indicated by like reference numerals. In the passive matrix display 150 the electroluminescent layer 108 comprises a plurality of pixels 152 and the cathode layer 110 comprises a plurality of mutually electrically insulated conductive lines 154, running into the page in FIG. 1*b*, each with an associated contact 156. Likewise the ITO anode layer 104 also comprises a plurality of anode lines 158, of which only one is shown in FIG. 1*b*, running at right angles to the cathode lines. Contacts (not shown in FIG. 1*b*) are also provided for each anode line. An electroluminescent pixel 152 at the intersection of a cathode line and anode line may be addressed by applying a voltage between the relevant anode and cathode lines.

Referring now to FIG. 2*a*, this shows, conceptually, a driving arrangement for a passive matrix OLED display 150 of the type shown in FIG. 1*b*. A plurality of constant current generators 200 are provided, each connected to a supply line 202 and to one of a plurality of column lines 204, of which for clarity only one is shown. A plurality of row lines 206 (of which only one is shown) is also provided and each of these may be selectively connected to a ground line 208 by a switched connection 210. As shown, with a positive supply voltage on line 202, column lines 204 comprise anode connections 158 and row lines 206 comprise cathode connections 154, although the connections would be reversed if the power supply line 202 was negative and with respect to ground line 208.

As illustrated pixel 212 of the display has power applied to it and is therefore illuminated. To create an image connection 210 for a row is maintained as each of the column lines is activated in turn until the complete row has been addressed, and then the next row is selected and the process repeated. Alternatively a row may be selected and all the columns written in parallel, that is a row selected and a current driven onto each of the column lines simultaneously, to simultaneously illuminate each pixel in a row at its desired brightness. Although this latter arrangement requires more column drive circuitry it is preferred because it allows a more rapid refresh of each pixel. In a further alternative arrangement each pixel in a column may be addressed in turn before the next column is addressed, although this is not preferred because of the effect, inter alia, of column capacitance as discussed below. It will be appreciated that in the arrangement of FIG. 2*a* the functions of the column driver circuitry and row driver circuitry may be exchanged.

It is usual to provide a current-controlled rather than a voltage-controlled drive to an OLED because the brightness of an OLED is determined by the current flowing through it, this determining the number of photons it outputs. In a voltage-controlled configuration the brightness can vary across the area of a display and with time, temperature, and age, making it difficult to predict how bright a pixel will appear when driven by a given voltage. In a colour display the accuracy of colour representations may also be affected.

FIGS. 2*b* to 2*d* illustrate, respectively, the current drive 220 applied to a pixel, the voltage 222 across the pixel, and the light output 224 from the pixel over time 226 as the pixel is addressed. The row containing the pixel is addressed and at the time indicated by dashed line 228 the current is driven onto the column line for the pixel. The column line (and pixel) has an associated capacitance and thus the voltage gradually rises to a maximum 230. The pixel does not begin to emit light until a point 232 is reached where the voltage across the pixel is greater than the OLED diode voltage drop. Similarly when the drive current is turned off at time 234 the voltage and light output gradually decay as the column capacitance discharges. Where the pixels in a row are all written simultaneously, that is where the columns are driven in parallel, the time interval between times 228 and 234 corresponds to a line scan period.

It is desirable for many applications, but by no means essential, to be able to provide a greyscale-type display, that is one in which the apparent brightness of individual pixels may be varied rather than simply set either on or off. Here "greyscale" refers to such a variable brightness display, whether a pixel is white or coloured.

The conventional method of varying pixel brightness is to vary pixel on-time using Pulse Width Modulation (PWM). In the context of FIG. 2*b* above the apparent pixel brightness may be varied by varying the percentage of the interval between times 228 and 234 for which drive current is applied. In a PWM scheme a pixel is either full on or completely off but the apparent brightness of a pixel varies because of time integration within the observer's eye.

Pulse Width Modulation schemes provide a good linear brightness response but to overcome effects related to the delayed pixel turn-on they generally employ a pre-charge current pulse (not shown in FIG. 2*b*) on the leading edge 236 of the driving current waveform, and sometimes a discharge pulse on the trailing edge 238 of the waveform. As a result, charging (and discharging) the column capacitance can account for roughly half the total power consumption in displays incorporating this type of brightness control. Other significant factors which the applicant has identified as contributing to the power consumption of a display plus driver combination include dissipation within the OLED itself (a function of OLED efficiency), resistive losses in the row and column lines and, importantly in a practical circuit, the effects of a limited current driver compliance, as explained in more detail later.

FIG. 3 shows a schematic diagram 300 of a generic driver circuit for a passive matrix OLED display. The OLED display is indicated by dashed line 302 and comprises a plurality n of row lines 304 each with a corresponding row electrode contact 306 and a plurality m of column lines 308 with a corresponding plurality of column electrode contacts 310. An OLED is connected between each pair of row and column lines with, in the illustrated arrangement, its anode connected to the column line. A y-driver 314 drives the column lines 308 with a constant current and an x-driver 316 drives the row lines 304, selectively connecting the row lines to ground. The y-driver 314 and x-driver 316 are typically both under the control of a processor 31S. A power supply 320 provides power to the circuitry and, in particular, to y-driver 314.

Specific examples of OLED display drivers are described in U.S. Pat. Nos. 6,014,119, 6,201,520, 6,332,661, EP 1,079,361A and EP 1,091,339A; OLED display driver integrated circuits are also sold by Clare Micronix of Clare, Inc., Beverly, Mass., USA. The Clare Micronix drivers provide a current controlled drive and achieve greyscaling using a conventional PWM approach; U.S. Pat. No. 6,014,119 describes a driver circuit in which pulse width modulation is used to control brightness; U.S. Pat. No. 6,201,520 describes driver circuitry in which each column driver has a constant current generator to provide digital (on/off) pixel control; U.S. Pat. No. 6,332,661 describes pixel driver circuitry in which a reference current generator sets the current output of a constant current driver for a plurality of columns, but again this arrangement is not suitable for variable brightness displays; and EP 1,079,361A and EP 1,091,339A both describe similar drivers for organic electroluminescent display elements in which a voltage drive rather than a current drive is employed.

It is generally desirable to reduce the power consumption of the display plus driver combination, particularly whilst retaining the ability to provide a greyscale display. It is further desirable to reduce the maximum required power supply voltage for the display plus driver combination.

Prior art techniques for reducing the power consumption of liquid crystal displays (LCDs) are described in U.S. Pat. No. 6,323,849 and EP 0 811 866A. U.S. Pat. No. 6,323,849 describes an LCD display with a partial display mode in which a control circuit controls display drivers to turn off a portion of the display which does not show useful information. When the LCD module is in a partial display mode the line frequency may also be reduced whilst maintaining the same frame refresh rate, allowing a lower voltage to be used to produce the same amount of charge. However, a user must predetermine which portion of the display is to be used, which will typically require additional control functions and software in the device for which the display is provided. EP 0 811 866A describes a similar technique, albeit with a more flexible driving arrangement. An improved reduced power consumption display driver which provides for more transparent user implementation is described in the applicant's co-pending UK patent application number 0209502.4.

U.S. Pat. No. 4,823,121 describes an electroluminescent (EL) panel driving system which detects the absence of a HIGH level signal representing a spot illumination of the EL panel in the image data of a line and, in response to this, prevents four circuits (a pre-charge circuit, a pullup circuit, a write-in circuit and a source circuit) from being activated. However the power savings provided by this technique are specific to the drive arrangement for the type of electroluminescent panel described and are not readily generalisable. Furthermore the savings are relatively modest.

FIG. 4*a* shows a typical light intensity-voltage curve 400 for an OLED which, as can be seen, is non-linear and exhibits a dead region corresponding to the OLED turn-on voltage (typically 1.5V-2V). It is desirable to operate an OLED display at a lower rather than a higher voltage as this increases the device's efficiency (light output in terms of energy input) and reduces the degradation rate. Resistive losses are also reduced and, where image data is changing, capacitive losses (which depend upon the square of the voltage) are also reduced.

FIG. 4*b* shows a light intensity-current curve 402 for an OLED which, by contrast with curve 400, is approximately linear.

FIG. 4*c* shows, schematically, a current driver 402 for one column line of a passive matrix OLED display, such as the display 302 of FIG. 3. Typically a plurality of such current drivers are provided in a column driver integrated circuit, such as Y-driver 314 of FIG. 3, for driving a plurality of passive matrix display column electrodes.

A particularly advantageous form of current driver 402 is described in the applicant's co-pending British patent application no. 0126120.5 entitled "Display Driver Circuits". The current driver 402 of FIG. 4*c* outlines the main features of this circuit and comprises a current driver block 406 incorporating a bipolar transistor 416 which has an emitter terminal substantially directly connected to a power supply line 404 at supply voltage $V_s$. (This does not necessarily require that the emitter terminal should be connected to a power supply line or terminal for the driver by the most direct route but rather that there should preferably be no intervening components, apart from the intrinsic resistance of tracks or connections within the driver circuitry between the emitter and a power supply rail). A column drive output 408 provides a current drive to OLED 412, which also has a ground connection 414, normally via a row driver MOS switch (not shown in FIG. 4*c*). A current control input 410 is provided to current driver block 406 and, for the purposes of illustration, this is shown connected to the base of transistor 416 although in practice a current mirror arrangement is preferred. The signal on current control line 410 may comprise either a voltage or a current signal and this is preferably provided from a digital-to-analogue converter (not shown in FIG. 4*c*) for ease of interfacing.

A current source attempts to deliver a substantially constant current to the load to which it is connected but it will be appreciated that there will come a point as its output voltage approaches the supply voltage, at which this is no longer possible. The range of voltages over which a current source provides an approximately constant current to a load is termed the compliance of the current source. The compliance can be characterised by ($V_s$-$V_o$) where $V_s$ is the supply voltage and $V_o$ is substantially the maximum output voltage of the current source in that when $V_s$-$V_o$ is small the compliance is high, and vice-versa (For convenience in this document reference will be made to a current source and to current sources but these may be substituted by a current sinks or sinks).

The arrangement of FIG. 4*c* is useful because the (optionally variable) current generator has a high compliance, that is a low value of $V_s$-$V_o$. The lower the current driver compliance (i.e. the greater $V_s$-$V_o$), the greater the power losses due to limited driver compliance. The lower the driver circuit compliance the greater the supply voltage to the current driver must be in order to obtain a maximum desired pixel brightness, and hence the greater the power loss. This is particularly the case where pixel brightness is varied by varying the drive current rather than by, for example, pulse width modulation.

As previously explained current control is preferable to voltage control for an OLED because this helps to overcome the non-linearity of the light voltage curve shown in FIG. 4*a*, the light-current curve for an OLED being substantially linear. FIG. 4*d* shows a graph 420 of current drawn from a power supply against a power supply voltage for an organic LED display element driven from a controllable constant current source. This curve has an initial "dead" region in which substantially no current flows until the forward voltage is sufficient to turn the OLED on. A non-linear region 422 is then followed by a substantially flat portion 424 of the curve above a voltage indicated by dashed line 426, giving a generally 'S' shaped curve. At the voltage indicated by line 426 the supply voltage is sufficient to meet the compliance limit of the current source. In other words the voltage indicated by dashed line 426 is the minimum supply voltage required to ensure that the constant current source is well behaved at the current it is controlled to provide.

It can be seen that in region 424 of the curve of graph 420 increasing the power supply output voltage merely increased the excess, wasted power dissipation and it is therefore preferable to operate at or near the compliance limit indicated by dashed line 426 to minimise this wasted power. However, the power supply voltage for this compliance limit depends upon a number of factors including display age, display temperature and, where a variable current drive is employed, upon the current being provided by the constant current source. For example with an OLED at a constant brightness (that is at a substantially constant drive current) the voltage across the OLED falls as its temperature increases, and vice-versa. For those reasons a large overhead is generally built into the supply voltage to ensure that the combination of the display and its driver is able to perform according to a desired specification and across a temperature range. A consequence of this is that over much of a specified temperature range and/or when at less than maximum brightness the driven display is likely to be operating at significantly less than its maximum efficiency.

The applicants have recognised that significant power savings may be achieved with emissive display technology, and in particular with organic light emitting diode-based displays, by sensing a drive voltage to the display and controlling a power supply to a constant current driver for the display. The applicants have recognised that especially significant savings may be made by controlling the power supply so that the constant current driver operates at or near its compliance limit.

According to a first aspect of the present invention there is therefore provided display driver control circuitry for controlling a display driver for an electroluminescent display, the display comprising at least one electroluminescent display element, the driver including at least one substantially constant current generator for driving the display element, the control circuitry comprising a drive voltage sensor for sensing a voltage on a first line in which the current is regulated by said constant current generator; and a voltage controller coupled to said drive voltage sensor for controlling the voltage of a supply for said constant current generator in response to said sensed voltage, and configured to control said supply voltage to increase the efficiency of said display driver.

Controlling the supply voltage to the at least one constant current generator, which may be a current source or a current sink, in response to a voltage on a line in which the current is regulated by the constant current generator allows the supply voltage to be varied automatically as external factors such as temperature, display age and current drive change in order to achieve more efficient operation of the display driver and more particularly a reduced power consumption for the display and driver combination for the same perceived level of brightness. Thus the power supply voltage may be reduced when it is greater than that needed by the constant current generator in order to provide its regulated current, and preferably also increased where the supply voltage is insufficient. The display driver control circuit may be retro-fitted to existing display driver circuitry to increase its efficiency, in which case, the drive voltage sensor may be arranged to sense an external drive line of the driver, but in other embodiments the control circuitry may be integrated with other parts of the driver circuitry and the first line may be an "internal" line of the driver. Similarly, the (power) supply may comprise part of the driver or of the control circuitry or power may be supplied by a separate, controllable module. The constant current generator may comprise an adjustable or controllable constant current generator, for example to provide variable pixel brightness for colour, or it may provide a substantially fixed current source or sink, for example in displays in which pixel brightness is varied by pulse width modulation (PWM) or where pixel brightness is fixed.

Preferably the voltage controller is configured to reduce the supply voltage to the constant current generator when such a reduction will not substantially reduce the regulated current sourced or sunk by the current generator and/or when such a reduction will not substantially change the perceived brightness of the display element driven by the constant current generator. Broadly speaking this amounts to permitting the voltage controller to control the power supply to reduce the supply voltage to the constant current generator when the current generator is operating at or below its limit of compliance. Preferably the voltage controller is configured to control the supply voltage so that the constant current generator operates in the vicinity of the compliance limit. Generally operating either slightly above or slightly below the compliance limit, which may not be a hard limit, will provide satisfactory results and, in some embodiments, the supply voltage may be controlled by means of a feedback mechanism which allows or requires the supply voltage at times to be either side of the compliance limit. However, preferably the supply voltage is controlled so that it is held substantially at a voltage which, for the purposes of the control circuitry, represents a sufficiently close approximation to the compliance limit that any variations in pixel brightness due to the supply voltage control are difficult to discern by a human observer under normal operating conditions. Preferably the control circuitry includes means to determine such a compliance limit which, as will be appreciated, need not exactly correspond with what might be termed an actual compliance limit determined, for example, by inspection of a graph such as that shown in FIG. 4*d* (which to some extent is an idealisation).

The control circuitry preferably further includes a supply voltage sensor for sensing the supply voltage to the constant current generator; in embodiments the same sensor may be employed for sensing both the voltage on an output (44 sink) of the current generator and the voltage on an input for power supply to the current generator. The voltage controller may then include means to determine a difference between the supply voltage and the drive voltage on the first line, to facilitate determination of whether or not the constant current generator is operating in the vicinity of its compliance limit. Although the control circuitry can be employed with a display driver having only a single constant current generator, advantageously the display driver has a plurality of constant current generators for simultaneously driving a corresponding plurality of display elements, such as the display elements in a row of a passive matrix display. Then the control circuitry preferably determines the maximum voltage on an output of one of the constant current generators and controls the power supply voltage in response to this maximum sensed voltage. The display element or pixel driven at this maximum voltage will, broadly speaking, be the most inefficient display element for pixel amongst those having the maximum brightness at any one time. Where the simultaneously driven display elements comprise display elements in a row of a pixellated display, the supply voltage may be controlled based upon the maximum voltage of current generators driving that row, in effect to control the supply voltage on a row-by-row basis. Alternatively where, as usual with a pixellated passive matrix display, the rows are driven sequentially the maximum voltage may be the maximum voltage of all the rows of the display, that is the maximum voltage of a displayed frame, and the supply voltage may be controlled on a frame-by-frame basis. This choice is available because a pixellated passive matrix display is generally only driven a row at a time although appearing to provide a uniformed display to a human observer because of the rapidity of the row refresh. Thus the supply voltage may be reduced when this will not reduce the regulated current or pixel brightness of the pixel with the highest drive voltage in a particular row being driven. Thus the supply voltage may be changed as each row of the display is driven according to the need (i.e. brightness, efficiency and the like) of the pixels in that particular row. It will be appreciated that this potentially provides improved power savings. Again the supply voltage may be sensed and controlled responsive to either the difference between the supply voltage and a maximum determined drive line voltage or responsive to the minimum difference between the supply voltage and a drive line sensed voltage, in mathematical terms these being equivalent.

Preferably the display is a passive electroluminescent display such as a small molecule or polymer-based organic light emitting diode (OLED) display. The display driver controls circuitry may comprise part of the circuitry of an integrated circuit on which row and/or column drivers for a passive matrix display may also be included. The skilled person will recognise that denoting lines of pixels or display elements as rows and columns is essentially arbitrary and that in a passive matrix display, the matrix need not be rectangular. The skilled person will further recognise that the control circuitry may be employed with fixed or variable constant current generators. The power supply for the constant current generators is preferably of the voltage convertor type, such as a switch mode power supply, so that the supply voltage may be reduced without substantially affecting the power supply efficiency. Where a switch mode power supply is employed, this will preferably have a relatively high switching frequency, for example greater than 1 MHz, thus facilitating rapid changes in the supply voltage.

The lower the current driver compliance (i.e. the greater $V_s$-$V_o$), the greater the power losses due to limited driver compliance. It is therefore preferable that a constant current generator or driver with high compliance is employed because this will allow the use of a lower power supply output voltage. Thus preferably a current generator for the display comprises at least one bipolar transistor in series with a current drive output to the display and, preferably, this transistor has an emitter terminal substantially directly connected to a power supply input or connection, and a collector terminal coupled to an electrode driver output. Preferably the voltage drop between the emitter terminal and the power supply connection is less than expected statistical variations in $V_{be}$ of the transistor, that is typically less than 100 mV, probably less than 50 mV.

Preferably the controllable current generator comprises a current mirror as this allows $V_o$ to approach typically to within less than 0.5V of the supply, and sometimes to within 0.1V of the supply. A pair of bipolar transistors need not be provided for each driver circuit (although this may be preferable in some embodiments) as a current minor circuit may, in effect, be shared by a plurality of driver circuits, for example across a plurality of display column electrodes. A current minor has a finite output impedance and thus the output current can vary by up to 25% over the output compliance range (broadly because $V_{be}$ varies slightly with collector voltage for a given drive current).

This effect can be reduced by employing a Wilson current mirror although the compliance is then degraded.

The functions of the above-described display driver control circuitry may be implemented using discrete components and/or integrated circuits or in silicon, or in an ASIC (Application Specific Integrated Circuits) or a FPGA (Field Programmable Gate Array), or by means of a dedicated processor with appropriate processor control code.

According to another aspect of the invention there is provided a method of reducing the power consumption of a display driver driving an electroluminescent display, the display comprising at least one electroluminescent display element, the driver including at least one substantially constant current generator for driving the display element and having a power supply for supplying power at a supply voltage for said current generator, the method comprising sensing a voltage on a first line coupled to the current generator, the current in which first line is regulated by the current generator; and controlling said supply voltage responsive to said sensed voltage to reduce said supply voltage when a reduction may be made without substantially altering said regulated current.

Broadly speaking this method provides similar advantages and benefits to the above described display driver control circuitry. The first line will generally be an output of the current generator, that is an output providing a substantially constant current from a current source for an "output", the current following into which is controlled by a current sink. Preferably the controlling controls the supply voltage such that the current generator operates at or near its compliance limit. However, the voltage sensing need not sense a voltage directly at the output of the current generator as the compliance limit can be determined, for example, by finding a knee in a current-voltage curve for the current generator rather than by detecting an absolute voltage value. The compliance limit may be determined by determining the change in sensed voltage with supply voltage (since below the limit of compliance the sensed voltage will stay approximately constant as the supply voltage is reduced) or a sensed voltage limit based upon a known or assumed limit of compliance may be employed. In some embodiments the method includes determining a current generator compliance limit for use in controlling the supply voltage.

The method may be applied to an existing display driver without modification to the driver by sensing the voltage on a control line or electrode of the display. Preferably the display comprises a plurality of simultaneously driveable display elements, such as a row of a passive matrix display, and the method further comprises sensing the voltage on a drive line for each of these elements and controlling the supply voltage to constant current generators driving these drive lines in response to the maximum sensed voltage from the drive lines. The supply voltage (or a voltage dependent upon the supply voltage) may also be measured and the supply voltage controlled in response to the voltage difference between a voltage on a current drive line, or where there is a plurality of drive lines the maximum drive voltage, and the sensed supply voltage. Where there is a plurality of simultaneously driven display elements, this difference may be determined by determining the maximum sensed voltage or by determining the minimum difference between the supply voltage and a sensed drive voltage so that the display element or pixel requiring the greatest drive may be driven from a supply providing no more than the necessary additional voltage needed by the display element's constant current generator for the set current drive level.

In a preferred embodiment of the method the one or more electroluminescent display elements comprise OLEDs such as small molecule or polymer OLEDs.

The invention further provides display driver circuitry configured to implement the above described method.

The invention further provides processor control code, and a carrier medium carrying the code, to implement the above described methods and display driver control circuitry functions. This code may comprise conventional program code or microcode or code for setting up or controlling an ASIC or FPGA. The carrier may comprise a storage medium such as a hard or floppy disk, CD- or DVD-ROM or programmed memory such as read-only memory (firmware). As the skilled person will appreciate the code may be distributed between a plurality of coupled components in communication with one another.

These and other aspects of the invention will now be further described, by way of example only with reference to the accompanying figures in which:

FIGS. 1*a* and 1*b* show cross sections through, respectively, an organic light emitting diode and a passive matrix OLED display;

FIGS. 2*a* to 2*d* show, respectively, a conceptual driver arrangement for a passive matrix OLED display, a graph of current drive against time for a display pixel, a graph of pixel voltage against time, and a graph of pixel light output against time;

FIG. 3 shows a schematic diagram of a generic driver circuit for a passive matrix OLED display according to the prior art;

FIGS. 4*a* to 4*d* show, respectively, a light-voltage curve for an OLED display element, a light-current curve for an OLED display element, a current driver for a column of a passive matrix OLED display, and a current-voltage curve for an OLED display element and its associated current source;

Figure 5:
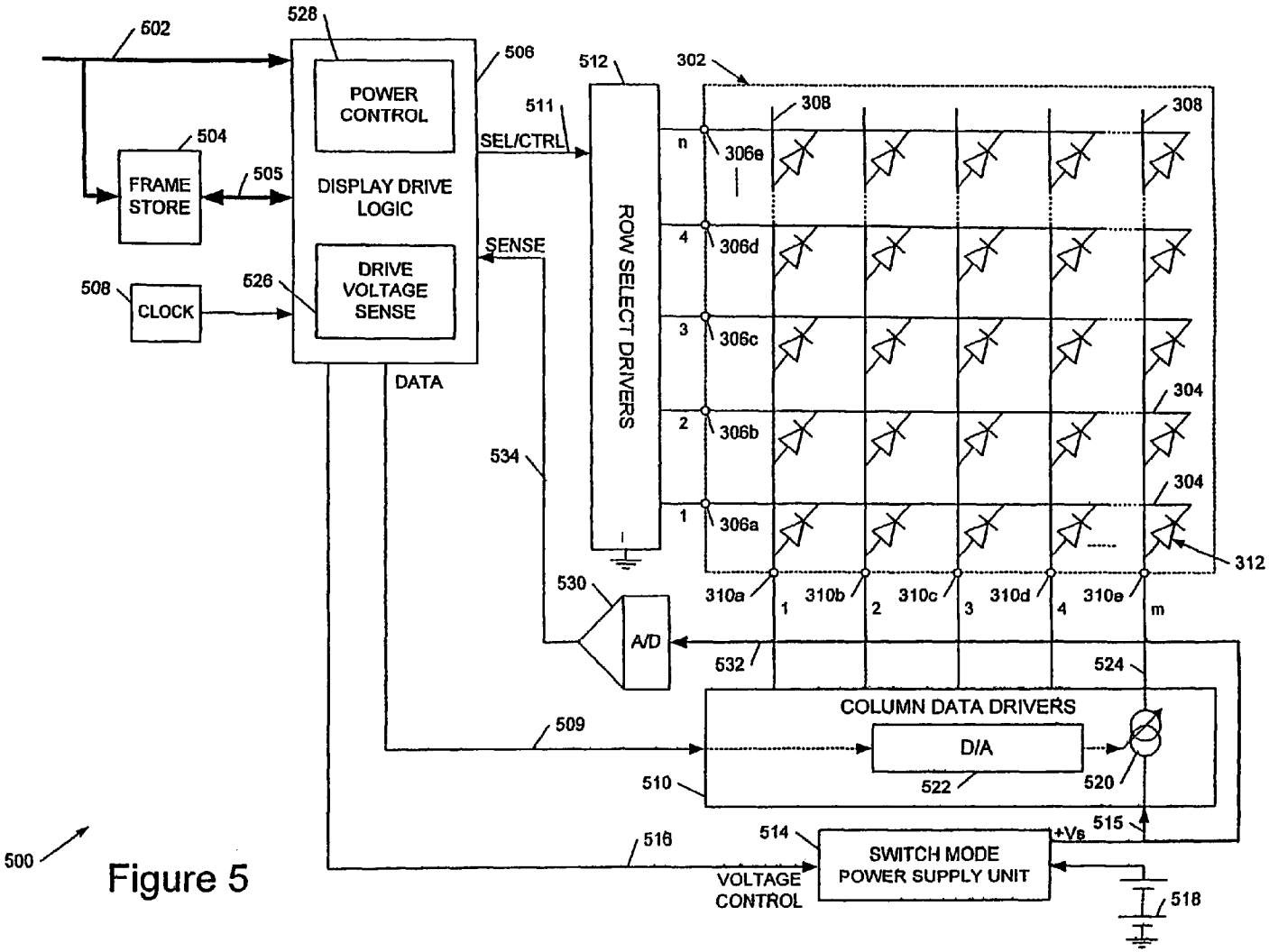
FIG. 5 shows a schematic diagram of passive matrix OLED driver circuitry according to a first embodiment of the present invention.

Turning now to FIG. 5, this shows a schematic diagram of a passive matrix OLED driver 500 which implements display drive voltage sensing to control a power supply to the display to provide improved efficiency, according to an embodiment of the present invention.

Figure 1A:
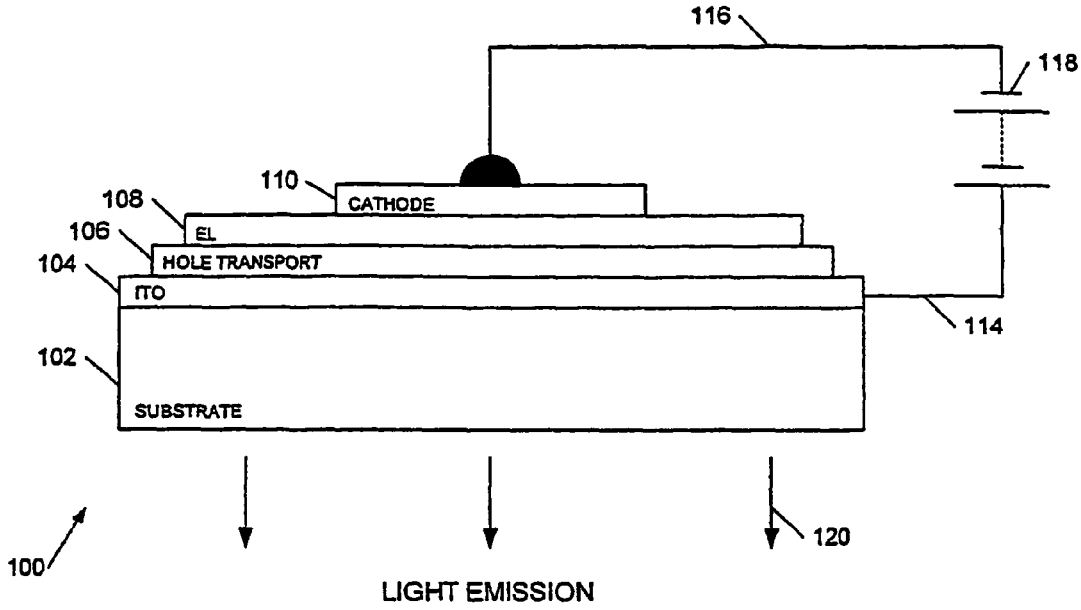
Figure 1a (PRIOR ART)
Figure 1B:
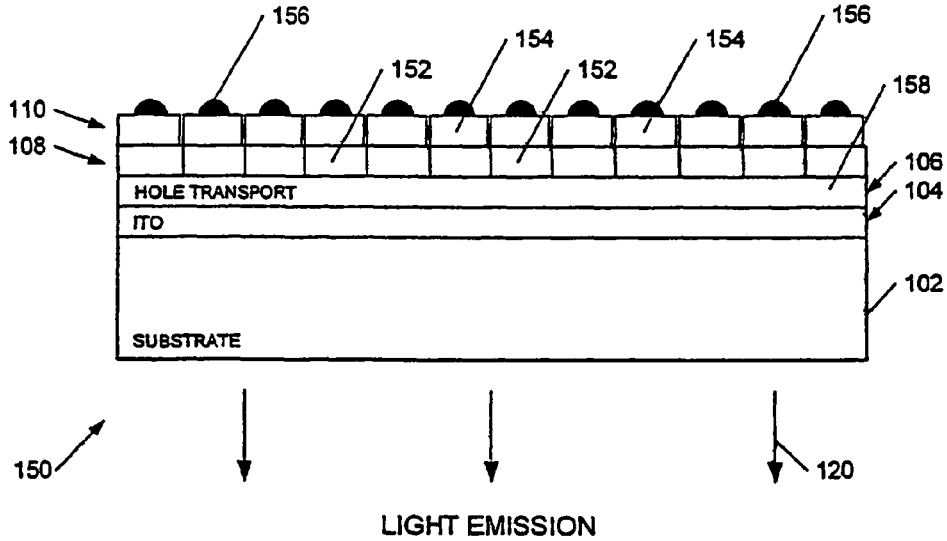
Figure 1b (PRIOR ART)
Figure 3:
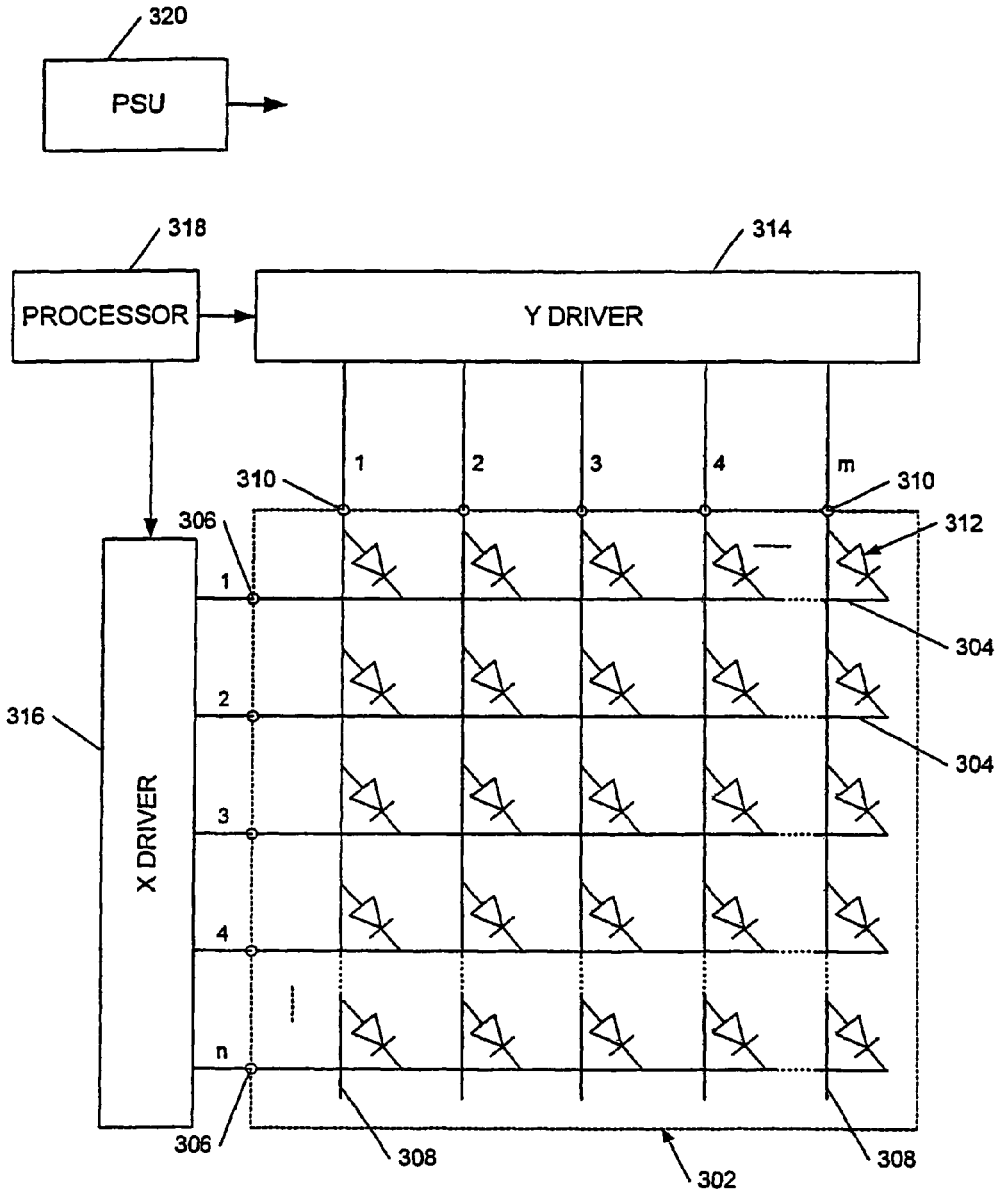
Figure 3 (PRIOR ART)
Figure 4A:
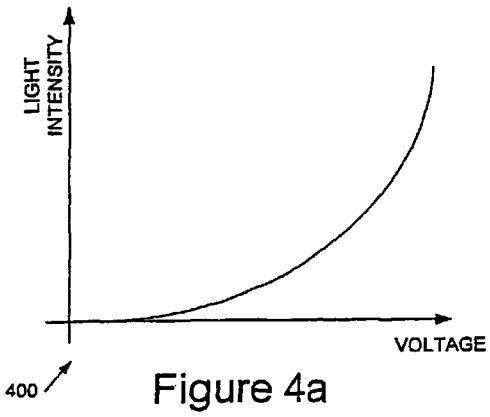
Figure 4B:
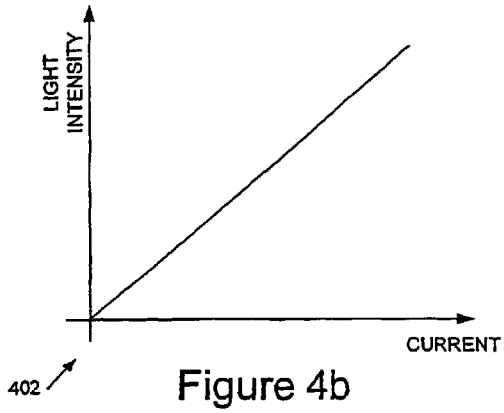
Figure 4C:
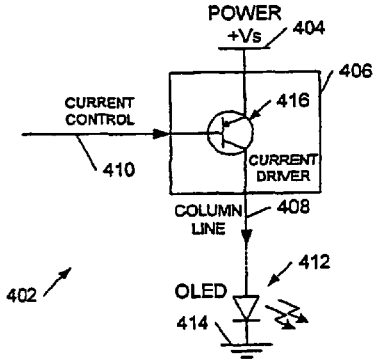
Figure 4D:
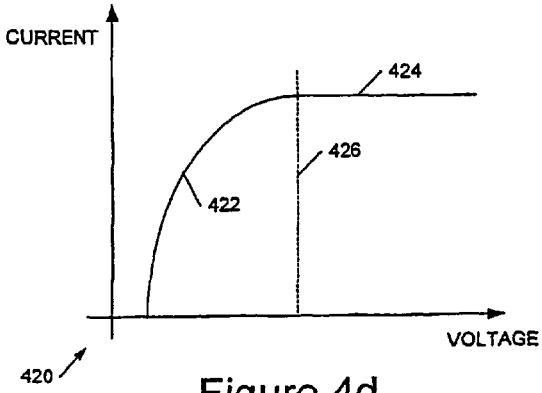

In FIG. 5 a passive matrix OLED display 302, similar to that described with reference to FIG. 3, has row electrodes 306 driven by row driver circuits 512 and column electrodes 310 driven by column drivers 510. The driver for each row typically comprises a MOS transistor to selectively connect a row electrode to ground; the driver for each column in a preferred embodiment comprises a substantially constant current generator 520 (as illustrated, a current source) such as that described with reference to FIG. 4*c*. In FIG. 5 only one of a plurality of constant current sources, one for each column, is shown for clarity. The current generator 520 is powered by a power supply voltage on line 515 and is controlled by an analogue output from a digital to analogue converter 522. A digital input to digital to analogue converter 552 is provided by control input 509. A digital to analogue converter 522 may be provided for each column electrode line such as line 524 or a single digital to analogue converter may be shared between the column lines, for example by time multiplexing.

As drawn in FIG. 5 the current source is a controllable current source to provide a variable brightness or greyscale display but in other embodiments fixed current sources may be employed. In these other embodiments pulse width modulation may be used to give the appearance of variable brightness to the human eye or, alternatively, the pixels of the display may all have substantially the same relative brightness, that is the display may not be a greyscale display. In still other embodiments the display may employ pixels of different colours to provide a variable colour display.

Row driver circuits 512 have a control input 511 for selecting one (or more) row electrodes for connection to ground. Column drivers 510 have a control input 509 for setting the current drive to one or more of the column electrodes. Preferably control inputs 509 and 511 are digital inputs for ease of interfacing and preferably control input 509 sets the current drives for all the m columns of display 302. A two-dimensional image may be presented on display 302 by selecting each row in turn and driving all the pixels in the selected row using column drivers 510, then selecting the next row and repeating the process to build up an image using a conventional raster scan pattern. Where a greyscale or colour display is to be provided a variable current drive is provided for each column according to the desired pixel brightness. In some embodiments of row driver circuitry 512 the raster scan function may be provided automatically by the row drivers under control of the control input 511.

A power supply unit 514 provides power to the various elements of the display driver 500 and, in particular, has an output 515 for powering the column drivers 510. The power supply unit 514 also has a control input 516 for controlling the output voltage provided to the column drivers on line 515.

Power supply unit 514 is preferably a switch mode power supply, with an input from a battery 602, preferably of a relatively low voltage, for example 3 volts, for compatibility with typical portable consumer electronic devices. The voltage provided on power supply output line 515 will generally be higher than the battery voltage, typically between 5 volts and 10 volts, for driving a passive matrix polymer OLED display to provide desirable brightness, although higher voltages, for example 30 volts or more, are generally required by so-called small molecule based OLED displays.

Data for display on display 302 is provided on data and control bus 502 which comprises, for example, at least one data line and a write line. Bus 502 may be either a parallel or a serial bus. Bus 502 provides an input to a frame store or memory 504 which stores display data for each pixel of display 302, in effect forming in the memory an image of the data for display. Thus, for example, one or more bits of memory may be associated with each pixel, defining a grey-scale pixel brightness level or a pixel colour. The data in frame store 504 is stored in such a way that the brightness values of pixels in a row may be read out and, in the illustrated embodiment, frame store 504 is dual ported, outputting data read from the frame store on a second, read data bus 505. In other embodiments the functions of data bus 502 and data bus 505 may be combined in a single data bus.

The passive matrix OLED driver 500 also incorporates display drive logic 506, for providing display data to control input 509 of column drivers 510 and for providing a row select or scan control output to control input 511 of row drivers 512 for controlling the raster scanning of the display. The timing or processing performed by display drive logic 506 is controlled by a clock signal from clock generator 508. The display drive logic 506 is also coupled to read data and control bus 505 for reading data from frame memory 504.

Display drive logic 506 operates in a conventional manner to read data from frame memory 504 and to provide control data signals to control inputs 509 and 511 to display this data on passive matrix display 302. However display drive logic 506 also includes drive voltage sense circuitry or control code 526 and power supply control circuitry or control code 528 responsive to the drive voltage sense unit 526, as described in more detail below.

An analogue to digital converter 530 is provided with a plurality of inputs 532, one for each of column electrode lines 310*a*-310*e* and one for switch mode power supply 514 supply voltage output line 515. Analogue to digital converter 530 senses the voltages on lines 310*a-e* and 515 and provides a digital output corresponding to each of these voltages on output 534, which may comprise a serial or parallel bus. Analogue to digital converter 530 may comprise separate analogue to digital converters for each of the sensed lines or may comprise a single analogue to digital converter, for example shared on a time multiplexed basis. In this way display drive logic 506 is provided with an input comprising a digital value corresponding to the sensed voltage on each of drive lines 310 and supply 515. Display drive logic 506 may process this logic either by means of conventional clock or combinatorial logic, for example implemented on an ASIC, and/or using a microprocessor.

In operation the drive voltage sense module, which may be implemented by dedicated logic or by means of control code for a microprocessor, controls analogue to digital converter 530, for example using a control bus (not shown) to read the voltages on lines 310*a-e* and on line 515 each time a row is selected and the pixels 312 in the row are driven by the constant current generators 520 of column data drivers 510. Only a single constant current driver 520 is shown in FIG. 5 for simplicity, but it can be appreciated that display drive logic 506 is able to read both the supply voltage 515 to this current generator and the voltage on the output 524, 310*e* of this current generator providing a substantially constant regulated current. The same applies to the other constant current generators of column drivers 510 not shown in FIG. 5. In this way the display drive logic 506 can determine whether or not current generator 520 is at or near its compliance limit.

The column data drivers of FIG. 5 permit a variable current drive to be applied to the column electrodes 310 and thus in any given row some pixels may be brighter than others. Although the column electrodes are current driven it will nonetheless be appreciated that generally speaking the brighter the pixel the larger the voltage applied to the pixel, in accordance with FIG. 4*a*. However, since in practice the characteristics of OLEDs in the display are not uniform pixels driven with the same current may require different voltages, depending upon their efficiency, age (in terms of use) and other factors. Current generator 520 attempts to provide a programmed level of current to a pixel and varies its output voltage accordingly. Provided that the supply voltage to constant current generator 520 is sufficient, the output voltage from the constant current generator will be sufficient to maintain the programmed current. As the supply voltage is reduced the output voltage of constant current generator 520 will remain approximately constant until the limit of compliance of the current generator is fixed, at which point a further reduction in supply voltage will result in a significant reduction in the output voltage of constant current generator 520, with the effect that it is not longer able to supply the current it has been programmed to produce (source or sink).

It will be appreciated from the foregoing discussion that the supply voltage from power supply unit 514 should be sufficient to allow the current generator driving the pixel in the selected row requiring the greatest current generator output voltage to substantially provide this voltage. The power control module 528, which again may comprise dedicated logic or processor control code (or a combination of the two), provides an output signal on line 516 to control the switch mode power supply unit 514 to provide a supply voltage output on line 515 to achieve this. In one embodiment power control module 528 determines the maximum voltage sensed on column lines 310*a*-3 and compares this with the supply voltage sensed from line 515 to determine whether or not any of constant current drivers 520 are at or near their compliance limit. In another embodiment power control module 528 determines a voltage across each constant current generator 520 by determining a difference between the input voltage (on line 515) and the output (for example on line 524) and identifies the minimum voltage across any one of the constant current generators and then checks this to determine whether or not the minimum voltage is sufficient for the compliance limit of the constant current generator. The compliance limit of the constant current generator may be known, at least approximately, or it may be determined by the power control module 528 or drive voltage sense module 526 or some other part of the display drive logic 506 or, in effect, by the power supply unit 514. This is described in more detail later.

Once power control module 528 has determined whether or not any of the constant current generators 520 are at or near their compliance limit, it is then able to control the supply voltage on line 515, either to reduce the supply voltage when the voltage is greater than that necessary to drive the required current into the brightest/most inefficient pixel or to increase the supply voltage when it is insufficient for the required current drive of at least one of the pixels in the row. For row-by-row based supply voltage control it will be appreciated that the power supply unit 514 should be able to respond to the control signal on line 516 sufficiently fast to achieve some power saving during an interval for which a row is illuminated, often referred to as a line period. Taking the example of a 320 column by 240 row display operating at 60 frames per second (240×60 rows per second) the line period is approximately 70 microseconds, 140 microseconds where dual scanning of 120 rows is employed to reduce capacitated losses. A switch mode power supply operating at a switching frequency of 1 MHz or greater and employing approximately 10 cycles of smoothing can respond in 10 microseconds which is ample for such a display. For higher resolution displays switch mode power supplies operating at higher frequencies for example 10 MHz may be employed.

In a variant of the above described embodiment the display drive logic 506 stores the voltage sensed on each column electrode line 310, as each row is addressed. In this way the maximum required drive voltage for a complete display frame can be determined and thus the switch mode power supply voltage may be reduced to the minimum necessary for the maximum required drive voltage of any pixel in the displayed frame. Thus power control module 528 in this embodiment operates on a frame-by-frame rather than a row-by-row basis and the supply voltage $V_s$ on line 515 is controlled more slowly. This operation may be preferred when a slower controlled loop is desired, for example to allow the display drive logic (or microprocessor) to run more slowly thus providing a further power saving. It will be recognised, however, that row-by-row control potentially allows the greatest power savings in the constant current generators 520.

It will be appreciated that embodiments of this power saving approach may be applied to column data drivers employing fixed rather than variable constant current generators and to driver circuits employing on/off or pulse width modulated brightness control using fixed constant current generators. However, the greatest benefits are provided by adaptively controlling the supply voltage in accordance with displayed pixel brightness (i.e. pixel drive voltage from a constant current generator) where variable brightness is achieved by driving the display using variable substantially constant current generators.

Figure 6:
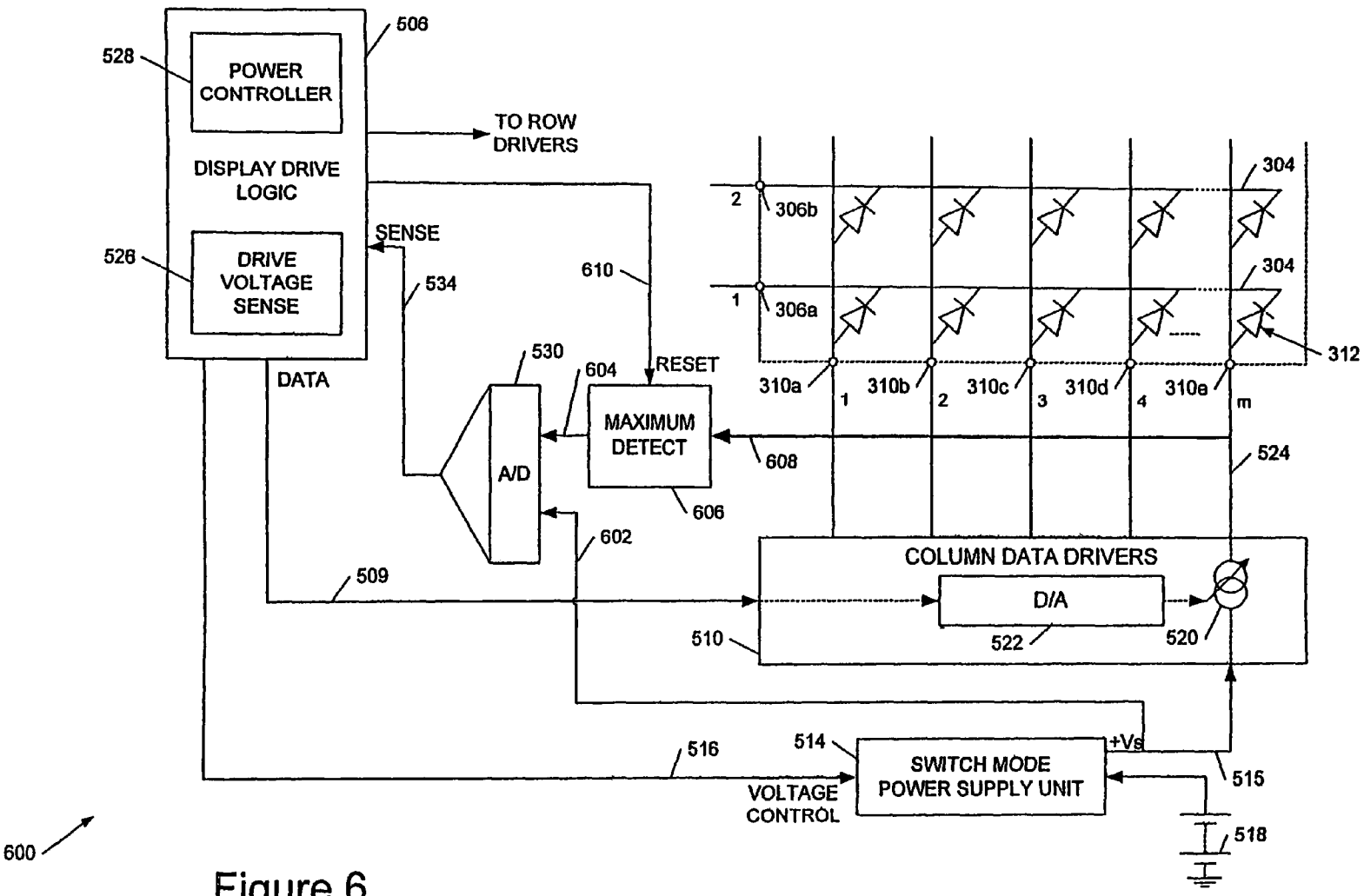
FIG. 6 shows a portion of a schematic diagram of passive matrix OLED driver circuitry according to a second embodiment of the present invention.

Referring now to FIG. 6, this shows a portion 600 of a schematic circuit diagram of a variant of the passive matrix OLED display driver of FIG. 5. Like elements to those in FIG. 5 are indicated by like reference numerals.

In FIG. 6, analogue to digital converter 530 has two inputs, a first input 602 from switch mode power supply unit supply line 515, as before and a second input 604 from a maximum voltage detect module 606. As before digitised versions of signals on inputs 602 and 604 are provided to display drive logic 506 on sense line 534. Again analogue to digital converter 530 may in practice comprise more than a single analogue to digital converter.

The maximum or peak voltage detect module 606 has a plurality of inputs 608, one from each of column electrode lines 310*a-e* and provides an output 604 corresponding to the maximum voltage on these separate input lines. The maximum detect module 606 has a reset input 610 driven by display drive logic 506 to allow the detected maximum from the column lines to be reset as each new row is selected. It can be appreciated that the maximum detect module performs some of the processing which, in FIG. 5, was performed by display drive logic 506 (either by drive voltage sense unit 526 or power controller 528). This simplifies the burden of processing on display drive logic 506 and reduces the number (or speed) of analogue to digital converters 530. As described above, power controller 528 provides an output on line 512 to control power supply 514 in response to the minimum difference between the voltage on line 515 and a voltage on lines 310*a-e*. This minimum voltage difference can be found by determining the maximum voltage on any of the column electrode lines 310*a-e* and then by determining the difference between this maximum voltage and the voltage on power supply output line 515.

Figure 7:
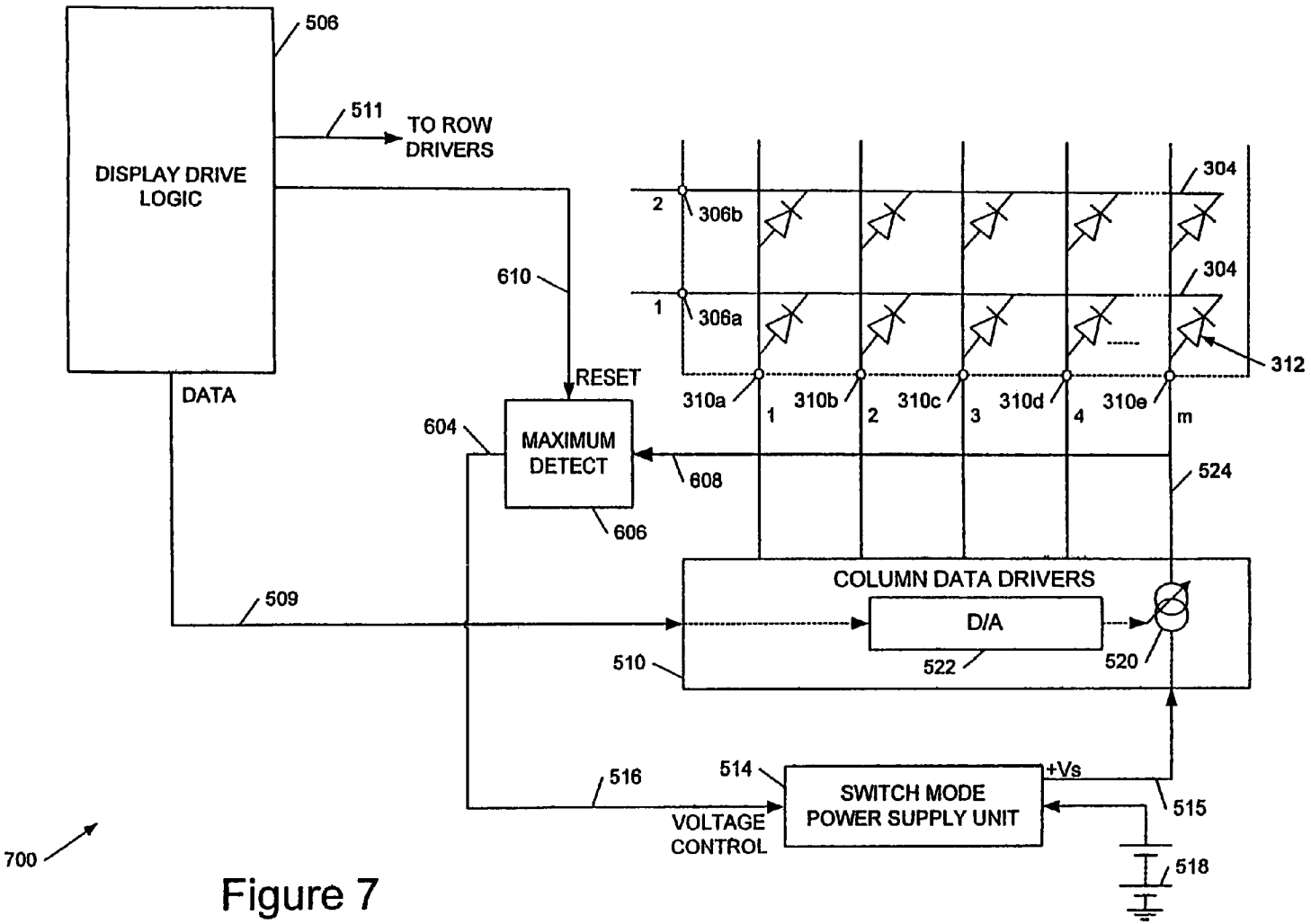
FIG. 7 shows a portion of a schematic diagram of passive matrix OLED driver circuitry according to a third embodiment of the present invention.

FIG. 7 shows a portion 700 of a schematic circuit diagram of a variant of the passive matrix OLED display driver of FIG. 6 and, again, like elements to those in FIG. 6 are indicated by like reference numerals.

In the arrangement of FIG. 7, the output 604 of maximum detect module 606 is coupled directly to the voltage control input 516 of power supply unit 514 and the necessary power supply voltage control functions are implemented in the switch mode power supply rather than in the display drive logic 506. Broadly speaking these functions may be implemented digitally in a similar way to that described above with reference to FIGS. 5 and 6, optionally by making use of an input to switch mode power supply 514 from the row driver output 511 of display drive logic 506 (not shown in FIG. 7) to determine when each new row is selected. However, the desired control function may be more straightforwardly implemented in power supply unit 514 by means of analogue control circuitry. Thus, for example, the difference between supply voltage output 515 and the maximum detected voltage on the column electrode lines, n line 516, may be determined by means of a differential amplifier. This difference may then be compared with a threshold, for example an estimated compliance limit or constant current generators 520, or a comparison may be made with a dynamically determined compliance limit. For example, a small variation may be superimposed on the supply voltage on line 515 and the magnitude of the variation on output 604 detected (since when the supply voltage is greater than necessary, changing the supply voltage will have little effect on the electrode line voltage). On the basis of the aforementioned comparison the supply voltage on line 515 may then be adjusted to either increase or decrease the supply voltage as necessary.

Figure 8:
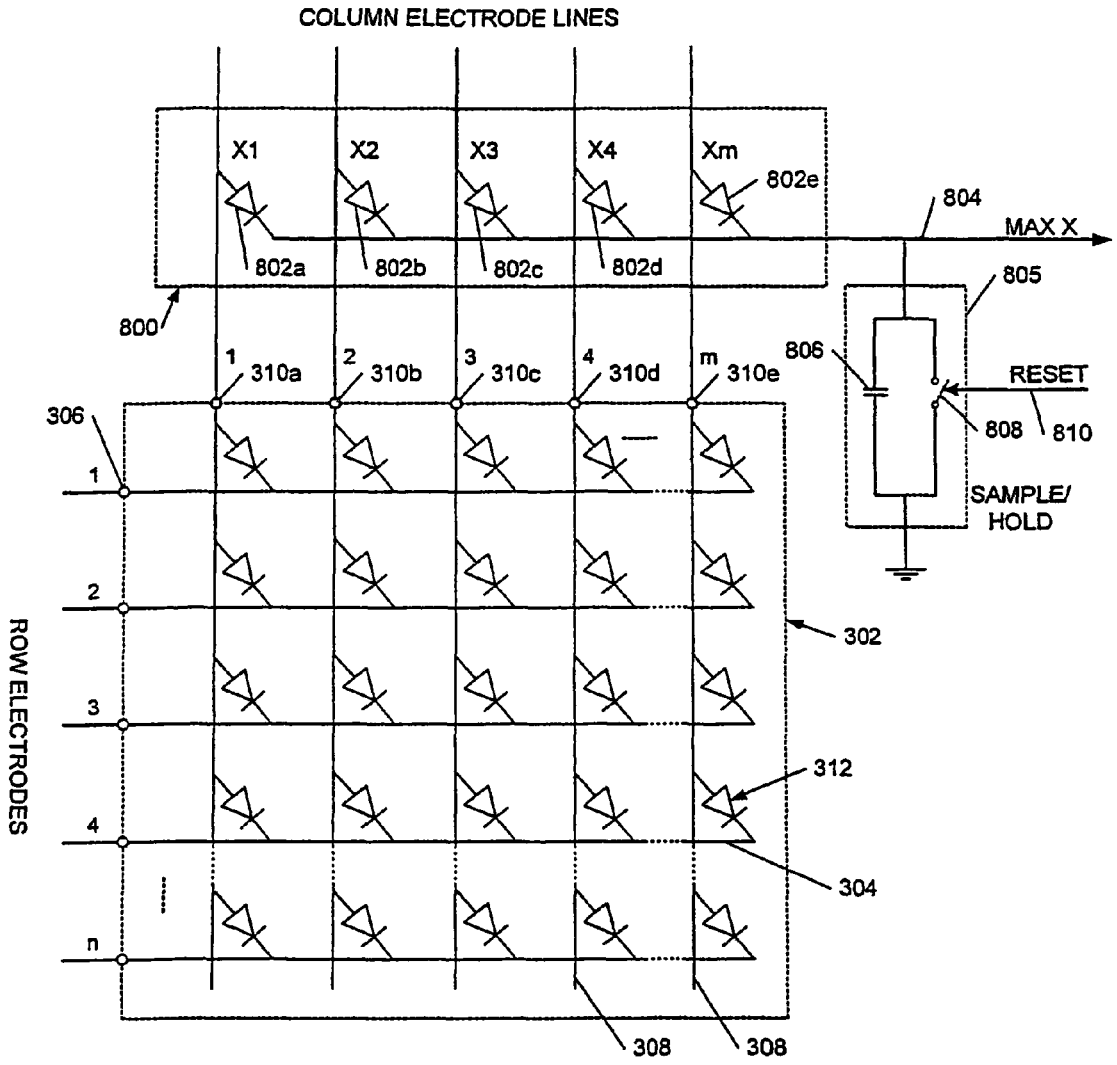
FIG. 8 shows a circuit diagram of a maximum voltage detector for use with embodiments of the present invention.

FIG. 8 shows a passive matrix OLED display 302 coupled to a maximum voltage detector 800 with a sample/hold circuit 806 suitable for use as the maximum detect module 606 of FIGS. 6 and 7.

In FIG. 8 each column electrode 310*a-e* is connected to a respective diode 802*a-e* to sample the respective voltage X1, X2, X3, X4, XM on the respective column line. The diode OR arrangement provides the maximum voltage, max X, on any one of the column electrode lines on output line 804 (less a diode voltage drop). Peak detect circuit 805 comprises a capacitor 806 to store the voltage on line 804 and a controllable switch 808 which is closed in response to a signal on reset line 810 to reset the charge on capacitor 806. The maximum detected voltage output on line 804 may be buffered with a high input impedance amplifier.

Figure 9:
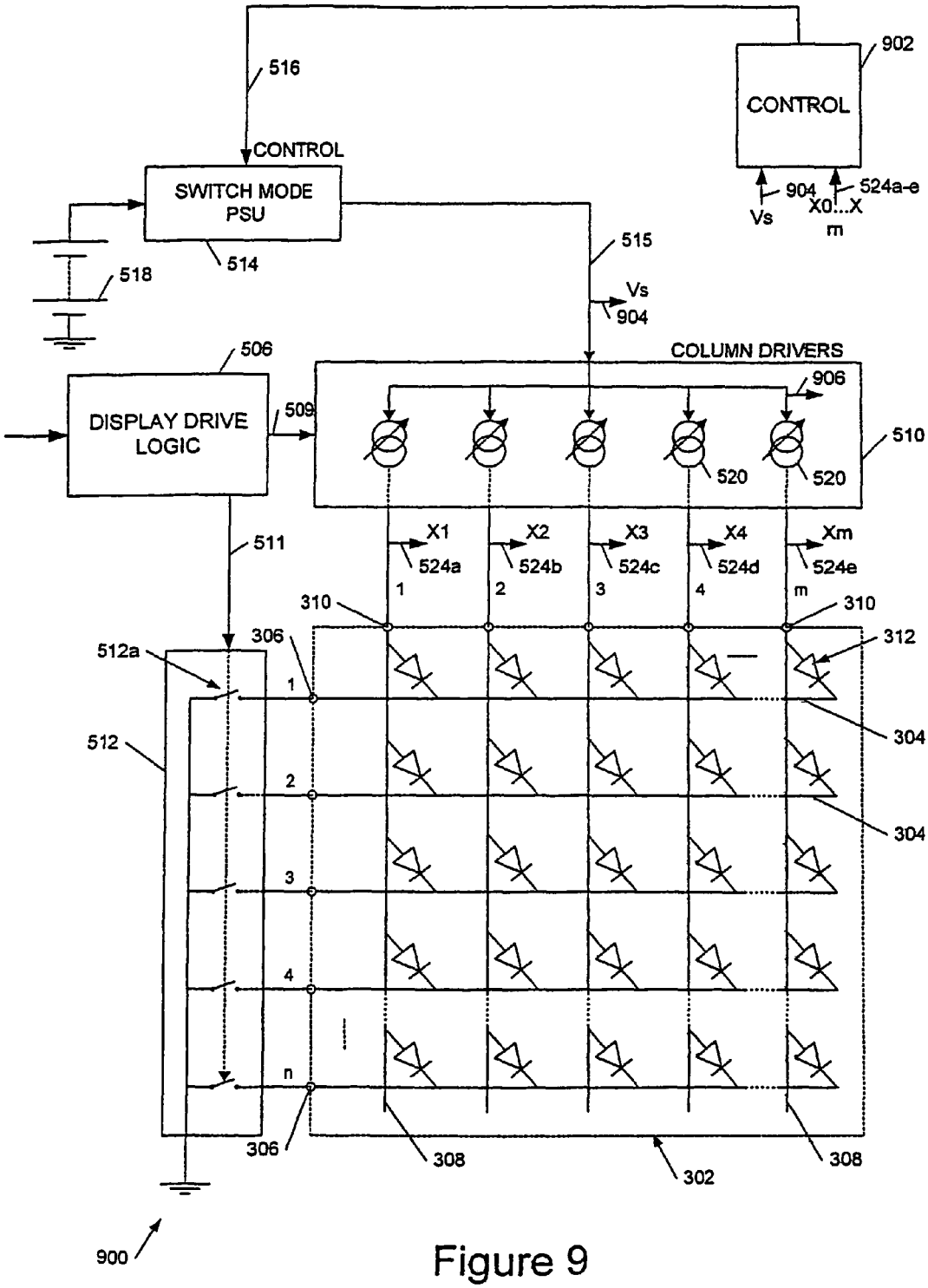
FIG. 9 shows a generic schematic diagram of passive matrix OLED driver circuitry according to an embodiment of the present invention.

FIG. 9 shows a generic circuit diagram of a passive matrix OLED driver incorporating power control embodying an aspect of the present invention. In FIG. 9, like elements to those of FIG. 5 are indicated by like reference numerals.

Each column line 310 is driven by a respective adjustable constant current generator 520. The voltage on each of column lines 1, 2, 3, 4, . . . m is denoted X1, X2, X3, X4, . . . Xm, and these voltages are tapped by lines 524*a-e*. The input or supply voltage Vs on line 515 supplying constant current column drivers 520 is tapped by line 904. A control circuit 902 has inputs from line 904 and from lines 524*a-e* and provides a control output on line 516 to control switch mode power supply 514. In other arrangements an internal column driver tap, such as line 906, may be employed for sensing the supply voltage to the constant current generators. The control circuitry controls the power supply as previously discussed such that the minimum (Vs-Xi) is substantially at the compliance limit of the driver for Xi. Thus the power supply is controlled to reduce the power supply voltage as this minimum value increases, and vice versa.

Figure 10:
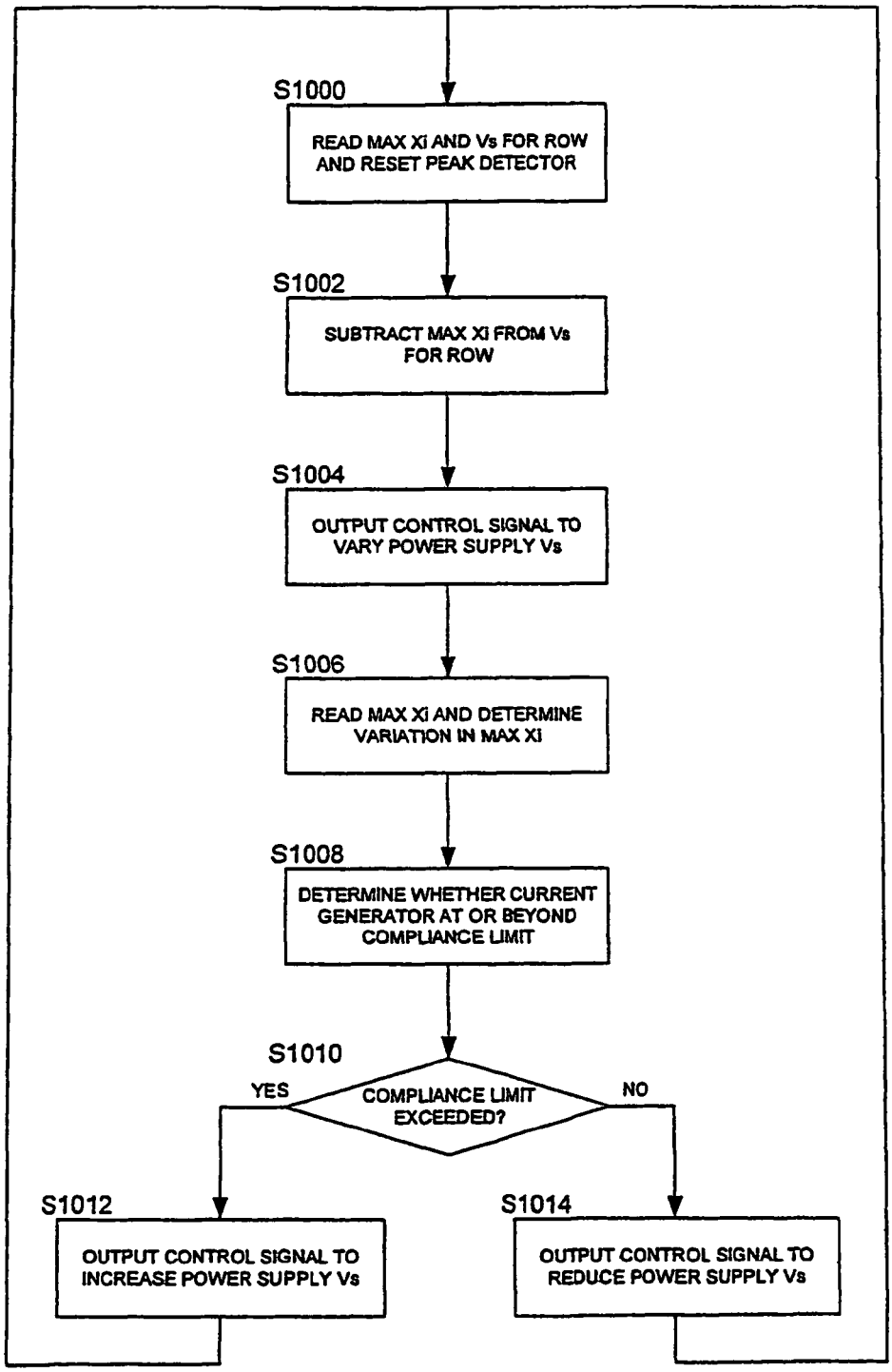
FIG. 10 shows a flow diagram of a power supply voltage control procedure according to an embodiment of the present invention.

FIG. 10 shows a flow diagram of a procedure which may be implemented by display drive logic such as display drive logic 506 of FIG. 5 to control the supply voltage of a current controlled passive matrix display driver to increase the efficiency of the driven display. Where display drive logic 506 comprises a microprocessor, the procedure of FIG. 10 may be implemented using appropriate processor control code.

The procedure of FIG. 10 assumes row-by-row power supply control but a similar procedure may be employed for frame-by-frame power supply control. For row-by-row control the steps of FIG. 10 are performed for each row in turn; for frame-by-frame control the steps of FIG. 10 are performed for each frame.

At step S1000 the processor reads the maximum column electrode voltage Xi and the column driver supply voltage Vs for the row and then resets the peak detector 805. The processor then subtracts the maximum Xi from Vs (for the row) to determine the minimum supply voltage overhead for a column driver constant current generator.

Steps S1004 to S1008 provide one way of determining whether a current generator is near its compliance limit. At step S1004 a control signal is provided to the power supply to vary the supply voltage Vs by a small amount and then, at step S1006, the variation in the maximum voltage Xi is read (if necessary resetting the sample hold) and the variation in the maximum voltage Xi is determined. If the variation is small the current generator is within its compliance limit, if the variation is above a threshold value the compliance limit of the constant current generator has been exceeded. This determination is made at step S1008.

At step S1010 the procedure determines whether or not the compliance limit has been exceeded. If the compliance limit has been exceeded at step S1012 a control signal is provided to increase the supply voltage Vs to the column drivers; if the compliance limit has not been exceeded at step S1014 a control signal is provided to reduce the supply voltage Vs to the column constant current drivers. In both cases the procedures end loops back to step S1000, either to repeat the procedure for the same row or to carry out the procedure on the next row of the display, where this has been selected. A better power supply voltage control is achieved with multiple loops through the procedure during each row or line period, although this will depend upon the speed of the processor and the duration of the line period.

No doubt many effective alternatives will occur to the skilled person. For example display drive logic 506, and more particularly the drive voltage sense and power control functions 526, 528 may be implemented using, at least in part, a state machine implemented on a PLA (Programmable Logic Array). Where a microprocessor is employed in drive logic 506 buses 502 and 505 may be combined in a shared address/data/control bus, although again frame memory 504 is preferably dual-ported to simplify interfacing the display to other devices.

It should be understood that the invention is not limited to the described embodiments but encompasses modifications apparent to those skilled in the art lying within the spirit and scope of the claims appended hereto.

The invention claimed is:

1. Display driver control circuitry for controlling a display driver for an electroluminescent display, the display comprising a plurality of electroluminescent display elements, the driver including a plurality of substantially constant current generators for simultaneously driving said plurality of display elements, each said constant current generator being configured for regulating the current on an associated display drive line driving a set of said electroluminescent display elements, the display driver control circuitry comprising:

a drive voltage sensor for sensing a voltage on a first line in which the current is regulated by said constant current generator;

a voltage controller coupled to said drive voltage sensor for controlling the voltage of a supply for said constant current generator in response to said sensed voltage, and configured to control said supply voltage to increase the efficiency of said display driver, wherein said voltage controller is configured to reduce said supply voltage when this will not substantially reduce said regulated current and/or said display brightness;

a drive voltage sensor for sensing the voltage on each said display drive line;

a maximum voltage detector to detect a maximum voltage from among the voltages sensed on each of said display drive lines;

a difference detector to detect a difference between said maximum voltage and said supply voltage; and a comparator to compare said difference with a threshold defining an estimated compliance limit of a said constant current generator, and wherein said voltage controller is responsive to an output of said comparator to control said supply voltage such that a said constant current generator driving said drive line having said detected maximum voltage operates in the vicinity of the compliance limit of the said constant current generator.

2. Display driver control circuitry as claimed in claim 1, further comprising means to determine a compliance limit for use by said voltage controller.

3. Display driver control circuitry according to claim, 1 further comprising a supply voltage sensor for sensing said supply voltage, and means to determine a difference between said supply voltage and said first line voltage, and wherein said voltage controller is configured to control said supply voltage responsive to said difference.

4. Display driver control circuitry according to claim 1, wherein said display comprises a passive matrix display, and wherein said voltage controller is configured to control said supply voltage on a frame-by-frame basis.

5. Display driver control circuitry according to claim 1, wherein said display comprises a passive matrix display having a plurality of rows of display elements, and wherein said voltage controller is configured to control said supply voltage on a row-by-row basis.

6. Display driver control circuitry according to claim 1 wherein said display has at least one control line for controlling the illumination of said at least one electroluminescent display element, wherein said drive voltage sensor is configured to sense the voltage on said display control line, and wherein said voltage controller has an output for controlling an adjustable power supply configured for providing said supply voltage.

7. A display driver including the display driver control circuitry of claim 1.

8. Display driver control circuitry as claimed in claim 1 wherein said electroluminescent display element comprises an organic light emitting diode.

9. A method of reducing the power consumption of a display driver driving an electroluminescent display, the display comprising a plurality of. electroluminescent display elements, the driver including a plurality of substantially constant current generators for simultaneously driving said plurality of the display elements, each said constant current generator being configured for regulating the current on an associated display drive line driving a set of said electroluminescent display elements, the display having a power supply for supplying power at a supply voltage for said current generators, the method comprising:

sensing a voltage on each said display drive line coupled to each respective said current generator; and controlling said supply voltage responsive to said sensed voltage to reduce said supply voltage when a reduction may be made without substantially altering said regulated current and such that said constant current generator operates in the vicinity of said constant current generator's compliance limit, and wherein said controlling comprises, detecting a maximum voltage from among the voltages sensed on each of said display drive lines, determining a difference between said maximum voltage and said supply voltage, comparing said difference with a threshold defining an estimated said compliance limit of a said constant current generator, and controlling said supply voltage using an output of said comparing such that a said constant current generator driving said drive line having said detected maximum voltage operates in the vicinity of the compliance limit of the said constant current generator.

10. A method according to claim 9, wherein a said substantially constant current generator comprises a current source.

11. A method according to claim 9, wherein a said substantially constant current generator comprises a current sink.

12. A method according to claim 9, wherein said display comprises a passive matrix display having a plurality of electroluminescent display elements and a plurality of row electrodes and a plurality of column electrodes for addressing said display elements, and wherein said driver is coupled to at least one of said plurality of row electrodes and said plurality of said column electrodes for driving said display.

13. A method according to claim 12 comprising performing said sensing and controlling on a row-by-row basis.

14. A method according to claim 12 comprising performing said sensing and controlling on a frame-by-frame basis.

15. A method according to claim 9, wherein a said electroluminescent display element comprises an organic light emitting diode.

16. A carrier carrying processor control code to implement the method of claim 9.

17. Display driver circuitry configured to implement the method of claim 9.

* * * * *

UNITED STATES PATENT AND TRADEMARK OFFICE

CERTIFICATE OF CORRECTION

PATENT NO. : 7,800,558 B2
APPLICATION NO. : 10/518286
DATED : September 21, 2010
INVENTOR(S) : Paul R. Routley et al.

It is certified that error appears in the above-identified patent and that said Letters Patent is hereby corrected as shown below:

In the Claims:

At Column 17, line 11, "of." should be -- of --.

Signed and Sealed this
Eighth Day of March, 2011

David J. Kappos

David J. Kappos
*Director of the United States Patent and Trademark Office*